US009909731B2

(12) United States Patent
Yamamura et al.

(10) Patent No.: US 9,909,731 B2
(45) Date of Patent: Mar. 6, 2018

(54) OPTICS UNIT AND VEHICULAR LIGHTING FIXTURE

(71) Applicant: Koito Manufacturing Co., Ltd., Tokyo (JP)

(72) Inventors: Satoshi Yamamura, Shizuoka (JP); Hidetada Tanaka, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/230,528

(22) Filed: Aug. 8, 2016

(65) Prior Publication Data

US 2016/0341390 A1 Nov. 24, 2016

Related U.S. Application Data

(63) Continuation of application No. PCT/JP2015/052850, filed on Feb. 2, 2015.

(30) Foreign Application Priority Data

Feb. 12, 2014 (JP) ..... 2014-024491

(51) Int. Cl.
*F21S 8/10* (2006.01)

(52) U.S. Cl.
CPC ..... *F21S 48/1757* (2013.01); *F21S 48/115* (2013.01); *F21S 48/1159* (2013.01); *F21S 48/1258* (2013.01); *F21S 48/137* (2013.01); *F21S 48/1323* (2013.01); *F21S 48/325* (2013.01); *F21S 48/328* (2013.01)

(58) Field of Classification Search
CPC ..... F21S 48/1757; F21S 48/1159; F21S 48/1258; F21S 48/1323; F21S 48/137; F21S 48/325; F21S 48/328; F21S 48/115
See application file for complete search history.

(56) References Cited

U.S. PATENT DOCUMENTS

2014/0043805 A1* 2/2014 Yamamura ..... F21S 48/1159 362/231

FOREIGN PATENT DOCUMENTS

| | | | |
|---|---|---|---|
| CN | 102436127 | A | 5/2012 |
| CN | 103492792 | A | 1/2014 |
| JP | 2012-018762 | A | 1/2012 |
| JP | 2012-073524 | A | 4/2012 |
| JP | 2012-181431 | A | 9/2012 |
| JP | 2012-227102 | A | 11/2012 |
| WO | 2011-129105 | A1 | 10/2011 |

OTHER PUBLICATIONS

International Search Report from International Application No. PCT/JP2015/052850, dated Mar. 10, 2015.
International Preliminary Report on Patentability from International Application No. PCT/JP2015/052850, dated Aug. 25, 2016.
Office Action for corresponding CN application No. 201580008446.1, (dated Dec. 21, 2017), SIPO.

* cited by examiner

*Primary Examiner* — Thomas M Sember

(57) ABSTRACT

An optics unit includes a light source and a rotary reflector that includes a rotation unit that rotates about an axis of rotation, and a blade mounted to the rotation unit, the blade including a reflective surface that reflects light emitted by the light source. The optics unit further includes a fan that includes a vane that rotates along with the rotation unit.

6 Claims, 11 Drawing Sheets

OPTICS UNIT AND VEHICULAR LIGHTING FIXTURE

CROSS-REFERENCE TO RELATED APPLICATIONS

This application is based upon and claims the benefit of priority from the prior Japanese Patent Application No. 2014-024491, filed on Feb. 12, 2014 and International Patent Application No. PCT/JP2015/052850, filed on Feb. 2, 2015, the entire content of each of which is incorporated herein by reference.

BACKGROUND OF THE INVENTION

1. Field of the Invention

The present invention relates to optics units, and in particular relates to optics units used in vehicular lighting fixtures.

2. Description of the Related Art

Optics units furnished with a rotary reflector that rotates unidirectionally about its rotational axis while reflecting light emitted from a light source are known (see JP2010-092124). Circumferentially with respect to its rotational axis the rotary reflector is provided with a plurality of blades provided with reflective surfaces whereby reflected light forms a desired light-distribution pattern. An advantage of this sort of optics unit that can form a desired light-distribution pattern by the unidirectional rotation of the rotary reflector is that load on the reflector's rotational driving unit is slight.

With the optics unit described in JP2010-092124, the rotary reflector is made to function as a cooling fan that through the rotation of the blades promotes heat dissipation by giving rise to convection currents in the air near a heat dissipation unit of the light source. Nevertheless, the airflow produced by the blades turns out to be directed parallel to the rotary reflector's rotational axis, meaning that the majority of the flow misses the heat dissipation unit, which is prohibitive of yielding sufficient cooling effectiveness.

SUMMARY OF THE INVENTION

An object of the present invention, brought about taking such circumstances into consideration, is in optics units furnished with a rotary reflector, to make available technology for effectively cooling the optics unit.

An optics unit according to an aspect of the present invention includes a light source; a rotary reflector that includes a rotation unit that rotates about an axis of rotation, and a blade mounted to the rotation unit, the blade including a reflective surface that reflects light emitted by the light source; and a fan that includes a vane that rotates along with the rotation unit.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

An optics unit according to an aspect of the present invention includes a light source; a rotary reflector that includes a rotation unit that rotates about an axis of rotation, and a blade mounted to the rotation unit, the blade including a reflective surface that reflects light emitted by the light source; and a fan that includes a vane that rotates along with the rotation unit.

According to this aspect, the cooling performance of the optics unit can be improved by providing a cooling fan separately from the rotary reflector.

The fan may be a blower fan. With this configuration, airflow can be produced by the blower fan in a direction orthogonal to the rotational axis of the rotary reflector.

The fan may be provided to a side of the rotary reflector reverse from its reflective surface. With this configuration, airflow can be produced without disturbing a light-distribution pattern formed by the rotary reflector.

An air duct for guiding airflow produced by the fan to either the light source or a driving source for rotationally driving the rotary reflector may be provided. The air duct can be used to guide the airflow to a portion with a high heating value, and the cooling performance thus improves.

A plurality of fins may be provided on a surface of the rotary reflector on a side thereof reverse from its reflective surface. With this configuration, the amount of the produced airflow can increase, and the cooling performance can thus further improve.

The optics unit may be mounted in a vehicular lighting fixture. In this case, the fan may be rotated starting with either vehicular idling, or when the vehicular lighting fixture is switched to low beam. With this configuration, a delay in the rise of the optics unit caused by an increase in the moment of inertia arising due to the fan being mounted to the rotary reflector can be suppressed.

The invention will now be described by reference to the preferred embodiments. This does not intend to limit the scope of the present invention but to exemplify the invention. The size of the component in each figure may be changed in order to aid understanding. Some of the components in each figure may be omitted if they are not important for explanation.

First Embodiment

Figure 1:
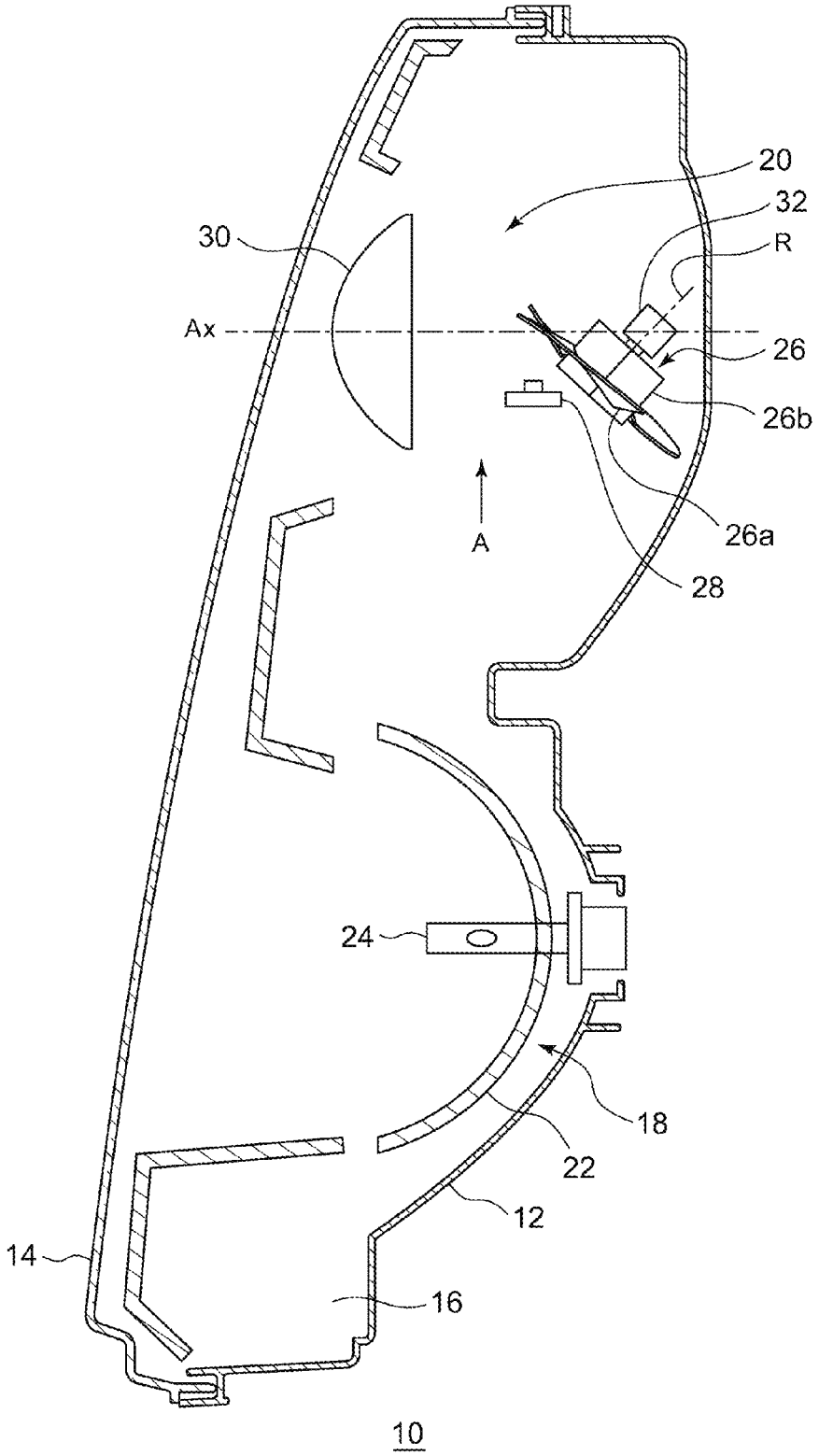
FIG. 1 is a horizontal sectional view of a vehicle headlamp according to a first embodiment.

FIG. 1 is a horizontal sectional view of a vehicle headlamp according to a first embodiment. A vehicle headlamp 10 is a right-side headlamp to be mounted on the front right side of an automobile and has the same structure as a headlamp to be mounted on the left side except that these headlamps are horizontally symmetrical. Therefore, the right-side vehicle headlamp 10 will be described in detail hereinafter, and the description of the left-side vehicle headlamp will be omitted.

As illustrated in FIG. 1, the vehicle headlamp 10 includes a lamp body 12 having a concave portion that opens toward the front side. The front opening of the lamp body 12 is covered by a transparent front cover 14, and thus a lamp room 16 is formed. The lamp room 16 functions as a space that houses two lamp units 18 and 20 disposed side by side in the widthwise direction of the vehicle.

The lamp unit on the outer side, or in other words, the lamp unit 20 illustrated in the upper side of FIG. 1 in the right-side vehicle headlamp 10 is a lamp unit that includes a lens and is configured to illuminate with a variable high beam. Meanwhile, the lamp unit on the inner side, or in other words, the lamp unit 18 illustrated in the lower side of FIG. 1 in the right-side vehicle headlamp 10 is configured to illuminate with a low beam.

The low-beam lamp unit 18 includes a reflector 22, a light source bulb (incandescent bulb) 24 supported by the reflector 22, and a shade (not illustrated). The reflector 22 is supported by a known mechanism (not illustrated), such as a mechanism that uses an aiming screw and a nut, so as to freely tilt relative to the lamp body 12.

As illustrated in FIG. 1, the lamp unit 20 includes a rotary reflector 26, an LED 28, and a convex lens 30 serving as a projection lens disposed in front of the rotary reflector 26. In place of the LED 28, a semiconductor light-emitting element, such as an EL element or an LD element, may be used as a light source. Alternatively, in place of the LED 28, a semiconductor laser or a light source that emits light by pumping a fluorescent body with a semiconductor laser may be used, or a combination of such a light source and an LED may be used as a light source. In particular, a light source that can be quickly turned on and off with high accuracy is preferable for carrying out control of blocking a portion of a light-distribution pattern, which will be described later. The shape of the convex lens 30 may be selected as appropriate in accordance with such light-distribution characteristics as required light-distribution pattern and illuminance distribution, and an aspherical lens or a free-form surface lens is used. In the present embodiment, an aspherical lens is used as the convex lens 30.

The rotary reflector 26 rotates unidirectionally about an axis of rotation R with a driving source 32, such as a motor. The rotary reflector 26 includes a reflective surface configured to reflect light emitted by the LED 28 to form a desired light-distribution pattern as the rotary reflector 26 rotates. In the present embodiment, the rotary reflector 26 constitutes an optics unit.

Figure 2:
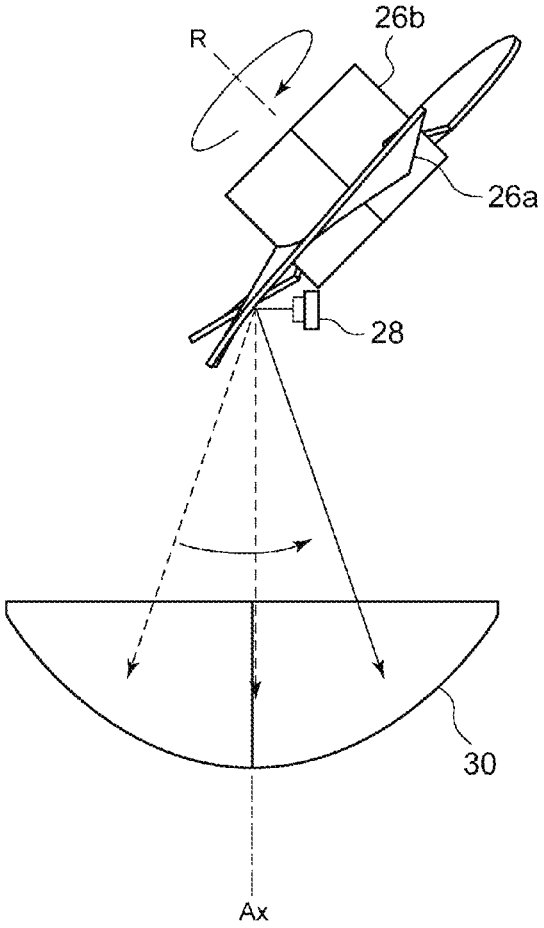
FIG. 2 is a top view schematically illustrating a configuration of a lamp unit that includes an optics unit according to the first embodiment.
Figure 3:
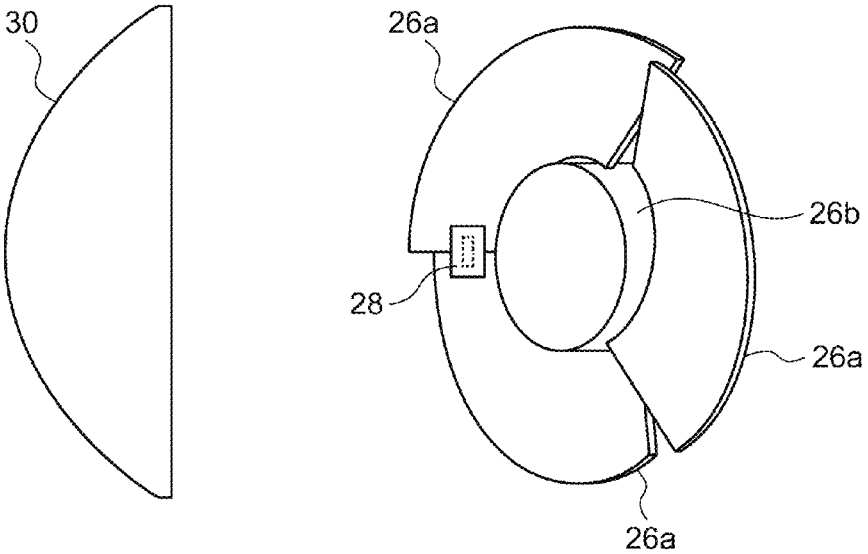
FIG. 3 is a side view of the lamp unit as viewed in the direction of an arrow A indicated in FIG. 1.

FIG. 2 is a top view schematically illustrating a configuration of the lamp unit 20 that includes the optics unit according to the present embodiment. FIG. 3 is a side view of the lamp unit 20 as viewed in the direction of an arrow A indicated in FIG. 1.

The rotary reflector 26 is provided with three blades **26*a* of an identical shape that function as reflective surfaces, and the blades 26*a* are provided on the circumference of a cylindrical rotation unit 26*b*. The axis of rotation R of the rotary reflector 26 is at an angle relative to an optical axis Ax and extends within a plane that contains the optical axis Ax and the LED 28. In other words, the axis of rotation R extends substantially parallel to the scanning plane of light (illumination beam) from the LED 28 that scans in the horizontal direction as the rotary reflector 26 rotates. Thus, the thickness of the optics unit can be reduced. The scanning plane can be seen, for example, as a fan-shaped plane formed by continuously connecting trajectories of the light from the LED 28 serving as scanning light. In the lamp unit 20 according to the present embodiment, the LED 28 provided therein is relatively small and is disposed at a position that is between the rotary reflector 26 and the convex lens 30 and that is offset from the optical axis Ax. Therefore, the size of the vehicle headlamp 10** in the depthwise direction (front and back direction of the vehicle) can be reduced as compared to a lamp unit of a conventional projector system in which a light source, a reflector, and a lens are disposed linearly along an optical axis.

Each blade **26*a* of the rotary reflector 26 is shaped such that a secondary light source of the LED 28 produced by reflection is formed near the focal point of the convex lens 30. In addition, each blade 26*a* has a twisted shape such that the angle formed by the optical axis Ax and the reflective surface changes along the circumferential direction with the axis of rotation Ax being the center. This configuration enables the scan with the light from the LED 28 as illustrated in FIG. 2**. This point will be described in further detail.

FIGS. 4A through 4E are perspective views each illustrating the state of the blades corresponding to a given angle of rotation of the rotary reflector 26 in the lamp unit according to the present embodiment. FIGS. 4F through 4J are illustrations for describing a feature that the direction in which the light from the light source is reflected changes in accordance with the states illustrated in FIGS. 4A through 4E, respectively.

Figure 4A:
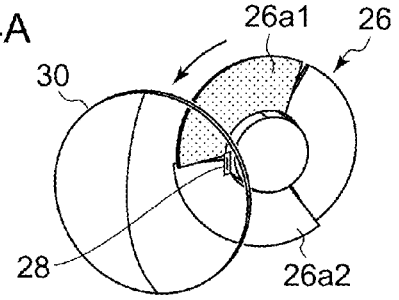
FIGS. 4A through 4E are perspective views each illustrating the state of blades corresponding to a given angle of rotation of a rotary reflector in the lamp unit according to the first embodiment.
Figure 4B:
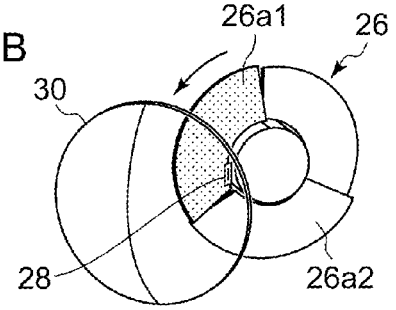

FIG. 4A illustrates a state in which the LED 28 is disposed to illuminate a boundary region between two blades **26*a*1 and 26*a*2. In this state, as illustrated in FIG. 4F, the light from the LED 28 is reflected by a reflective surface S of the blade 26*a*1 in a direction extending at an angle relative to the optical axis Ax. As a result, the light illuminates one of the right and left end portions of a region in front of the vehicle in which a light-distribution pattern is formed. Thereafter, the rotary reflector 26 rotates to enter the state illustrated in FIG. 4B. Then, the reflective surface S (reflection angle) of the blade 26*a*1 that reflects the light from the LED 28** changes because the blade 26*a*1 is twisted. As a result, as illustrated in FIG. 4G, the light from the LED 28 is reflected in a direction that is closer to the optical axis Ax than the reflection direction illustrated in FIG. 4F.

Figure 4C:
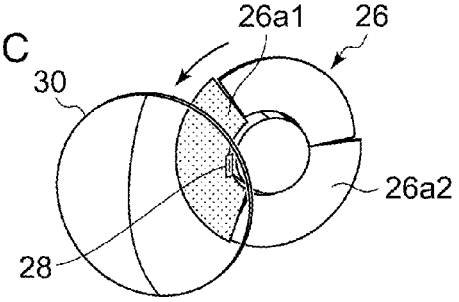
Figure 4D:
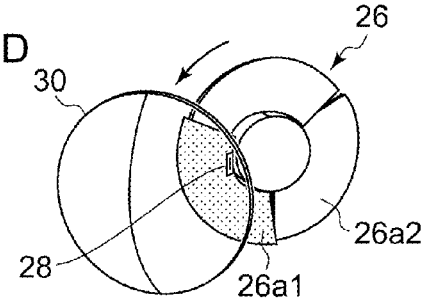
Figure 4E:
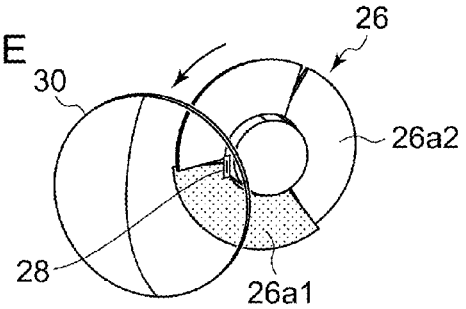
Figure 4F:
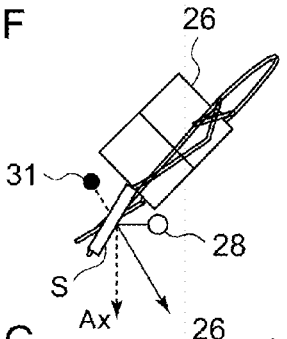
FIGS. 4F through 4J are illustrations for describing a feature that the direction in which light from a light source is reflected changes in accordance with the states illustrated in FIGS. 4A through 4E, respectively.
Figure 4G:
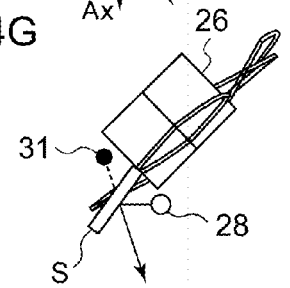
Figure 4H:
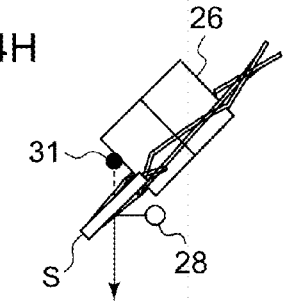
Figure 4I:
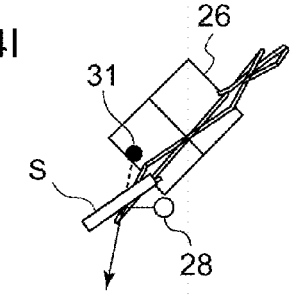
Figure 4J:
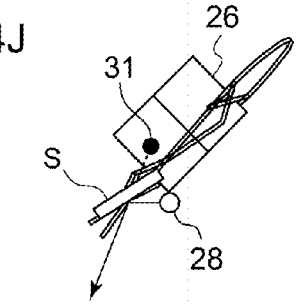
Figure 5A:
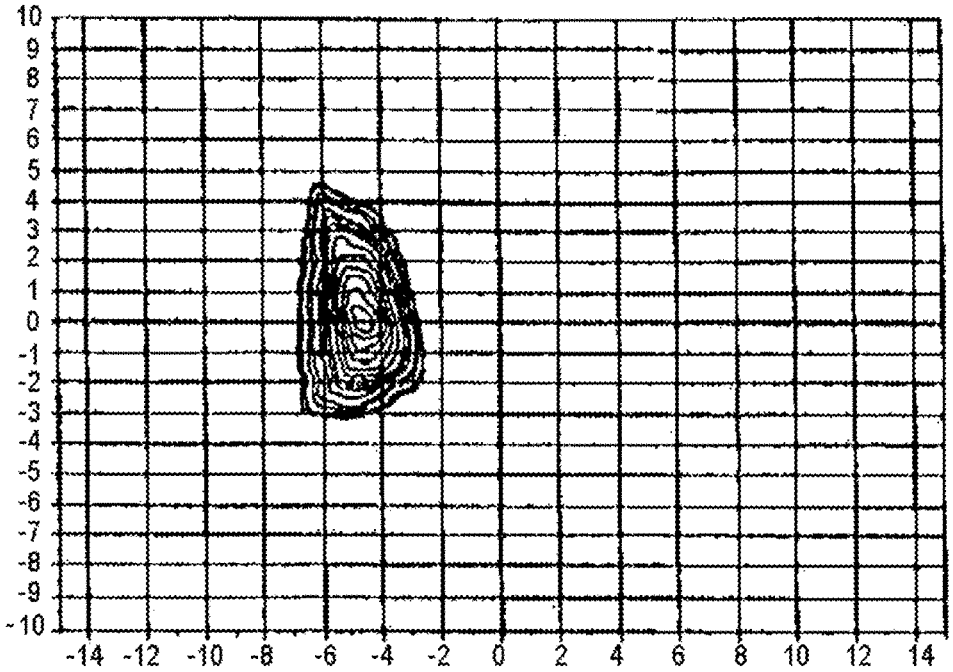
FIGS. 5A through 5E illustrate projection images obtained when the rotary reflector is at scanning positions corresponding to the states illustrated in FIGS. 4F through 4J, respectively.
Figure 5B:
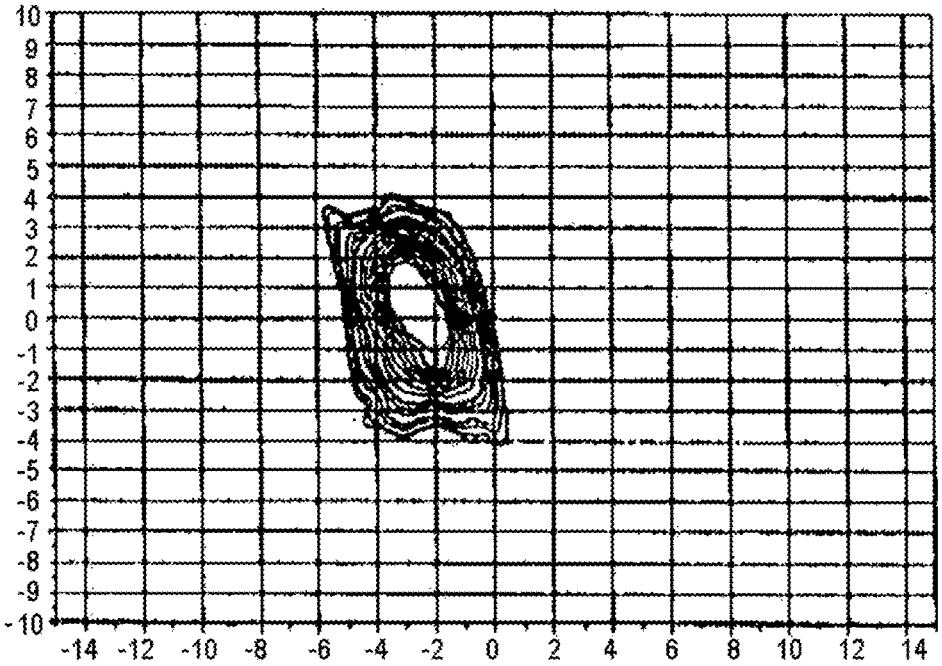
Figure 5C:
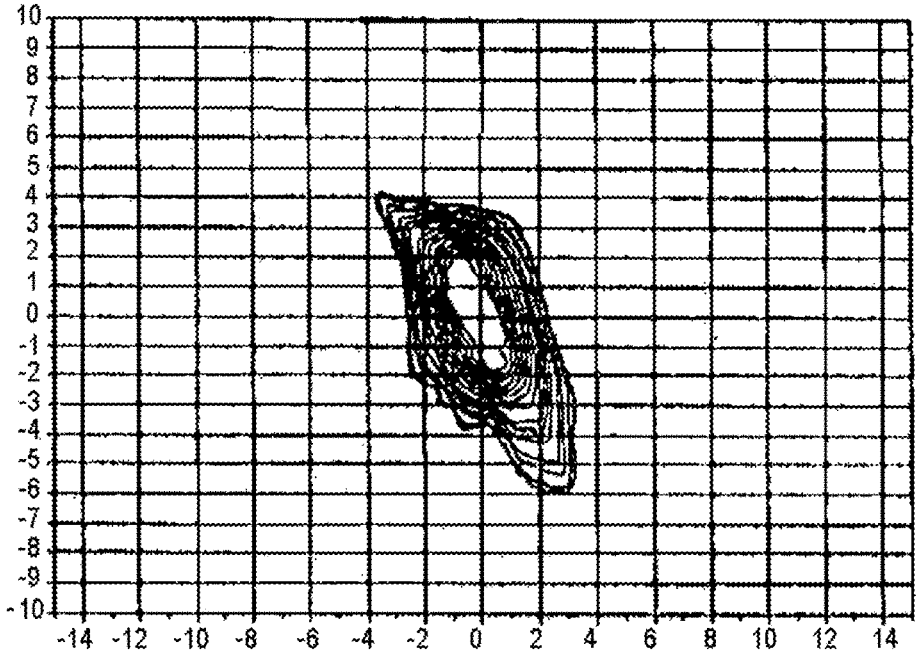
Figure 5D:
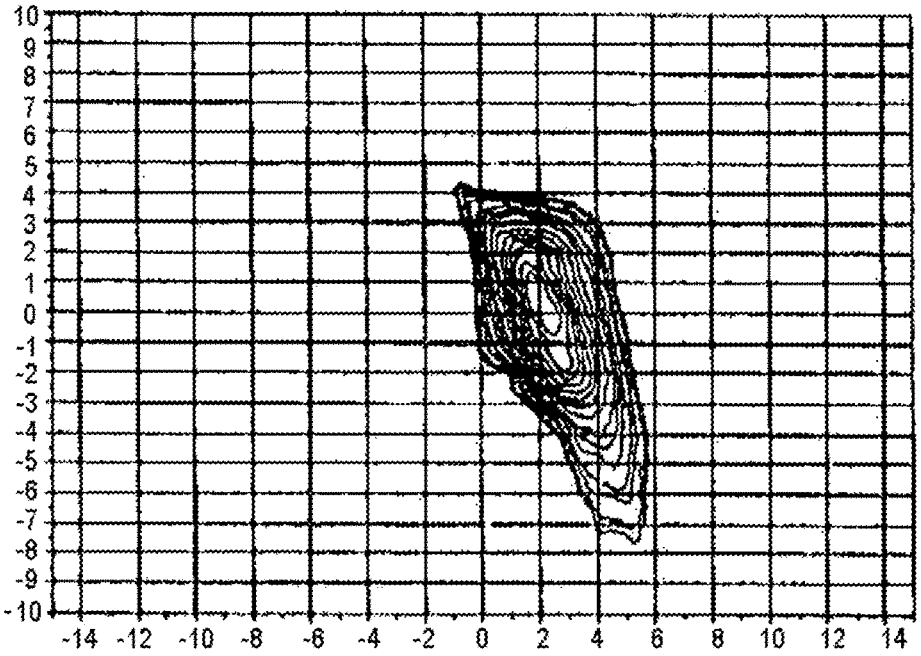
Figure 5E:
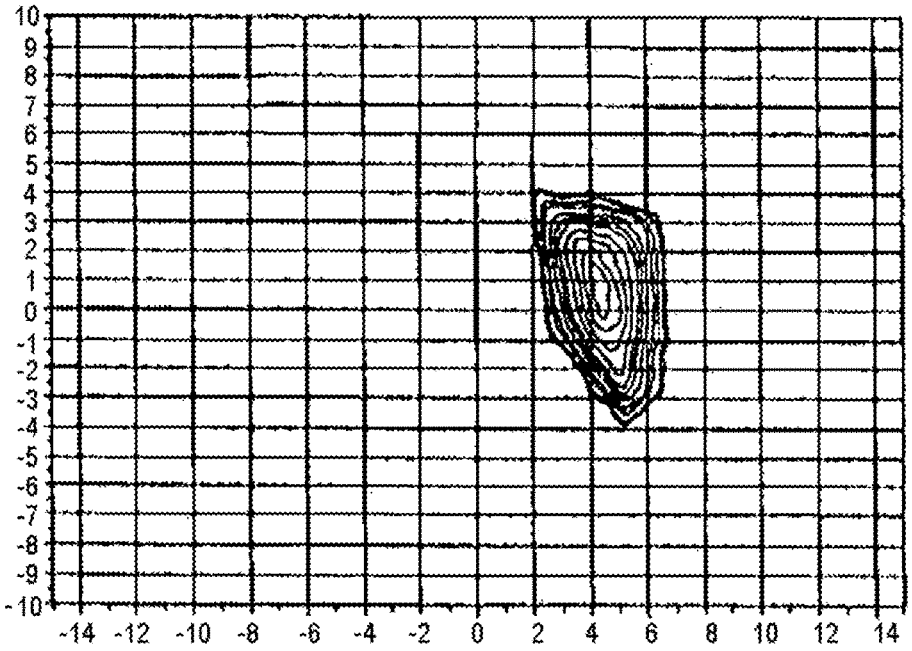

Subsequently, the rotary reflector 26 rotates as illustrated in FIGS. 4C, 4D, and 4E. Then, the direction in which the light from the LED 28 is reflected changes toward the other one of the right and left end portions of the region in front of the vehicle in which the light-distribution pattern is formed. The rotary reflector 26 according to the present embodiment can scan the front side once unidirectionally (in the horizontal direction) with the light from the LED 28 as the rotary reflector 26 rotates 120 degrees. In other words, a desired region in front of the vehicle is scanned once with the light from the LED 28 as a single blade 26*a* passes the front of the LED 28. As illustrated in FIGS. 4F through 4J, a secondary light source (light source virtual image) 31 moves horizontally near the focal point of the convex lens 30. The number of the blades 26*a*, the shape of each blade 26*a*, and the rotation speed of the rotary reflector 26 are set as appropriate on the basis of an experiment or a simulation result with the characteristics of a required light-distribution pattern or flicker of an image to be scanned taken into consideration. In addition, a motor is preferably used as a driving unit that can vary the rotation speed in accordance with various light distribution control. Thus, the scanning timing can be changed with ease. As such a motor, a motor that provides its own rotation timing information is preferable.

Specifically, a DC brushless motor may be used. When a DC brushless motor is used, its rotation timing information can be obtained from the motor, and thus a device such as an encoder can be omitted.

In this manner, the rotary reflector 26 according to the present embodiment can scan the front of the vehicle in the horizontal direction with the light from the LED 28 by appropriately controlling the shape or the rotation speed of the blades 26*a*. FIGS. 5A through 5E illustrate projection images obtained when the rotary reflector is at scanning positions corresponding to the states illustrated in FIGS. 4F through 4J, respectively. The units on the vertical axis and the horizontal axis of the figures are degrees (°), and the figures indicate irradiation ranges and irradiation positions. As illustrated in FIGS. 5A through 5E, the projection image moves in the horizontal direction as the rotary reflector 26 rotates.

Figure 6A:
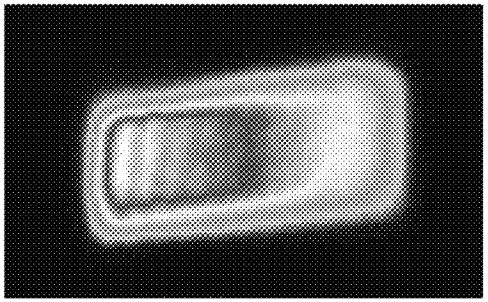
FIG. 6A illustrates a light-distribution pattern obtained when a range of ±5 degrees in the horizontal direction from the optical axis is scanned by using the vehicle headlamp according to the first embodiment.
Figure 6B:
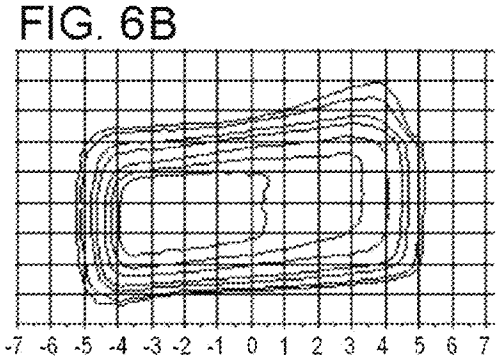
FIG. 6B illustrates a luminous intensity distribution of the light-distribution pattern illustrated in FIG. 6A.
Figure 6C:
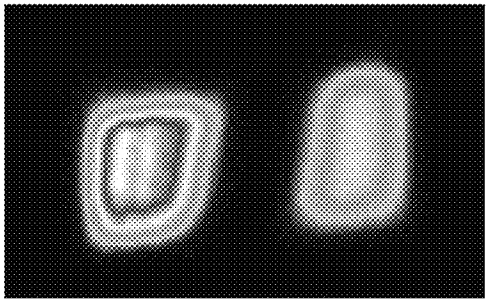
FIG. 6C illustrates a light-distribution pattern of which a portion is blocked by using the vehicle headlamp according to the first embodiment.
Figure 6D:
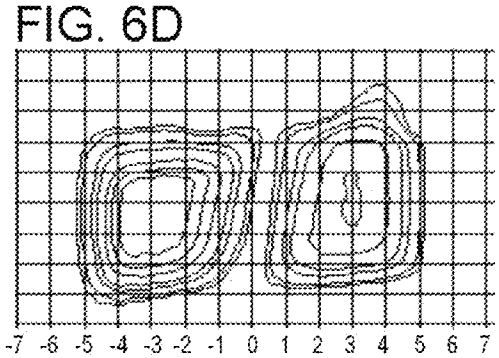
FIG. 6D illustrates a luminous intensity distribution of the light-distribution pattern illustrated in FIG. 6C.
Figure 6E:
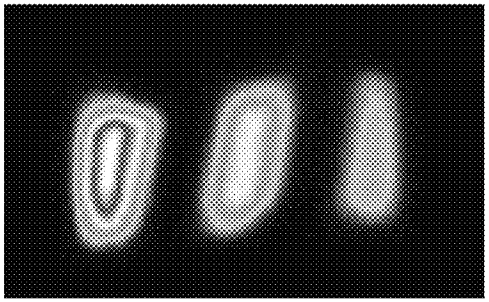
FIG. 6E illustrates a light-distribution pattern of which a plurality of portions are blocked by using the vehicle headlamp according to the first embodiment.
Figure 6F:
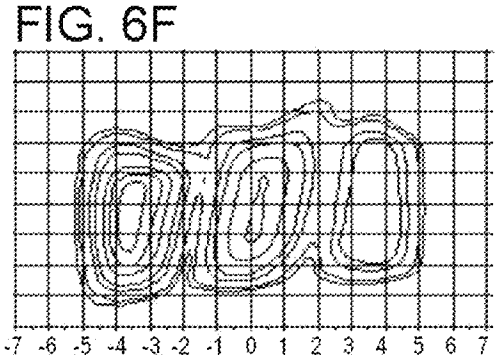
FIG. 6F illustrates a luminous intensity distribution of the light-distribution pattern illustrated in FIG. 6E.

FIG. 6A illustrates a light-distribution pattern obtained when a range of ±5 degrees in the horizontal direction from the optical axis is scanned by using the vehicle headlamp according to the present embodiment. FIG. 6B illustrates a luminous intensity distribution of the light-distribution pattern illustrated in FIG. 6A. FIG. 6C illustrates a light-distribution pattern of which a portion is blocked by using the vehicle headlamp according to the present embodiment. FIG. 6D illustrates a luminous intensity distribution of the light-distribution pattern illustrated in FIG. 6C. FIG. 6E illustrates a light-distribution pattern of which a plurality of portions are blocked by using the vehicle headlamp according to the present embodiment. FIG. 6F illustrates a luminous intensity distribution of the light-distribution pattern illustrated in FIG. 6E.

As illustrated in FIG. 6A, the vehicle headlamp 10 according to the present embodiment can form a substantially rectangular high-beam light-distribution pattern by reflecting the light from the LED 28 with the rotary reflector 26 and scanning the front with the reflected light. In this manner, a desired light-distribution pattern can be formed as the rotary reflector 26 rotates unidirectionally. Thus, driving of any specific mechanism, such as a resonance mirror, is not necessary, and there is no constraint on the size of the reflective surface as in a resonance mirror. Therefore, by employing a rotary reflector 26 having a larger reflective surface, light emitted by a light source can be used efficiently for illumination. In other words, the maximum luminous intensity in a light-distribution pattern can be increased. The rotary reflector 26 according to the present embodiment has a diameter that is substantially the same as the diameter of the convex lens 30, and the area of the blades 26*a* can be increased in accordance with the diameter of the convex lens 30.

The vehicle headlamp 10 that includes the optics unit according to the present embodiment can form a high-beam light-distribution pattern of which a desired region is blocked as illustrated in FIG. 6C or 6E by synchronizing the on/off timing of the LED 28 or a change in the light-emitting intensity with the rotation of the rotary reflector 26. When a high-beam light-distribution pattern is formed by changing the light-emitting luminous intensity of the LED 28 (turning on/off) in synchronization with the rotation of the rotary reflector 26, the light-distribution pattern itself can be swiveled by shifting the phase of the change in the luminous intensity.

As described thus far, the vehicle headlamp according to the present embodiment can form a light-distribution pattern by scanning with the light from the LED and form a blocked portion as desired at a portion of a light-distribution pattern by controlling the change in the light-emitting luminous intensity. Therefore, light in a desired region can be blocked with high accuracy with a small number of LEDs as compared to a case in which a blocked portion is formed by turning off some of a plurality of LEDs. In addition, the vehicle headlamp 10 can form a plurality of blocked portions, and thus even when a plurality of vehicles are present in front, light in regions corresponding to the respective vehicles can be blocked.

The vehicle headlamp 10 can control blocking of light without moving a basic light-distribution pattern, and thus a sense of discomfort on the driver at the time of light-blocking control can be reduced. In addition, a light-distribution pattern can be swiveled without moving the lamp unit 20, and thus the mechanism of the lamp unit 20 can be simplified. Therefore, it is sufficient that the vehicle headlamp 10 include, as a driving unit for variable light-distribution control, a motor necessary for rotating the rotary reflector 26, which can lead to a simple, low-cost, small-sized configuration.

Second Embodiment

Figure 7:
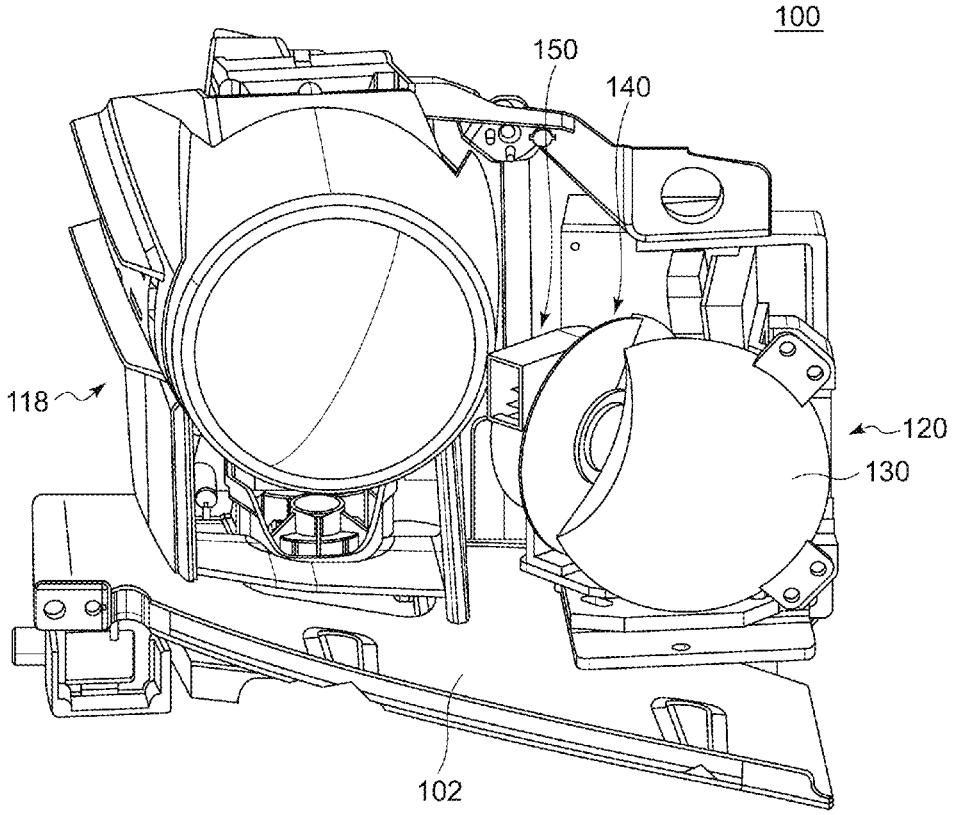
FIG. 7 is a schematic perspective view of a vehicular lighting fixture according to a second embodiment.

FIG. 7 is a schematic perspective view of a vehicular lighting fixture 100 according to a second embodiment as viewed from the upper left side. Similarly to the first embodiment, the vehicular lighting fixture 100 is a right-side headlamp to be mounted on the front right side of an automobile.

The vehicular lighting fixture 100 includes a lamp body 102 having a front opening, and the front opening is covered by a transparent front cover (not illustrated) to thus form a lamp room. In the lamp body 102, two lamp units 118 and 120 are disposed side by side in the widthwise direction of the vehicle.

The lamp unit 118 disposed on the outer side in the widthwise direction of the vehicle (left side in FIG. 7) is a lamp unit for forming a low beam that is constituted by a light source, a reflector having a reflective surface that reflects light emitted by the light source, and a projection lens. Such a lamp unit is well known, and thus detailed descriptions thereof will be omitted.

The optics unit 120 disposed on the inner side in the widthwise direction of the vehicle (right side in FIG. 7) is a lamp unit that includes a rotary reflector 140, similarly to the lamp unit 20 described in the first embodiment.

In addition to the lamp units 118 and 120, the vehicular lighting fixture 100 may also be provided with a lamp unit of a different type.

Figure 8:
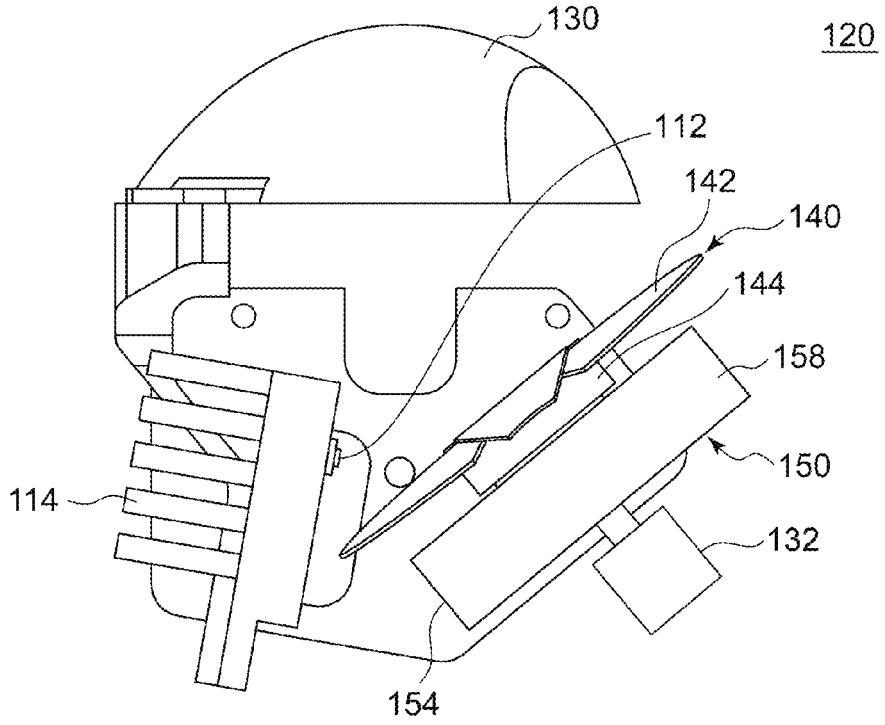
FIG. 8 is a top view of an optics unit illustrated in FIG. 7.
Figure 9:
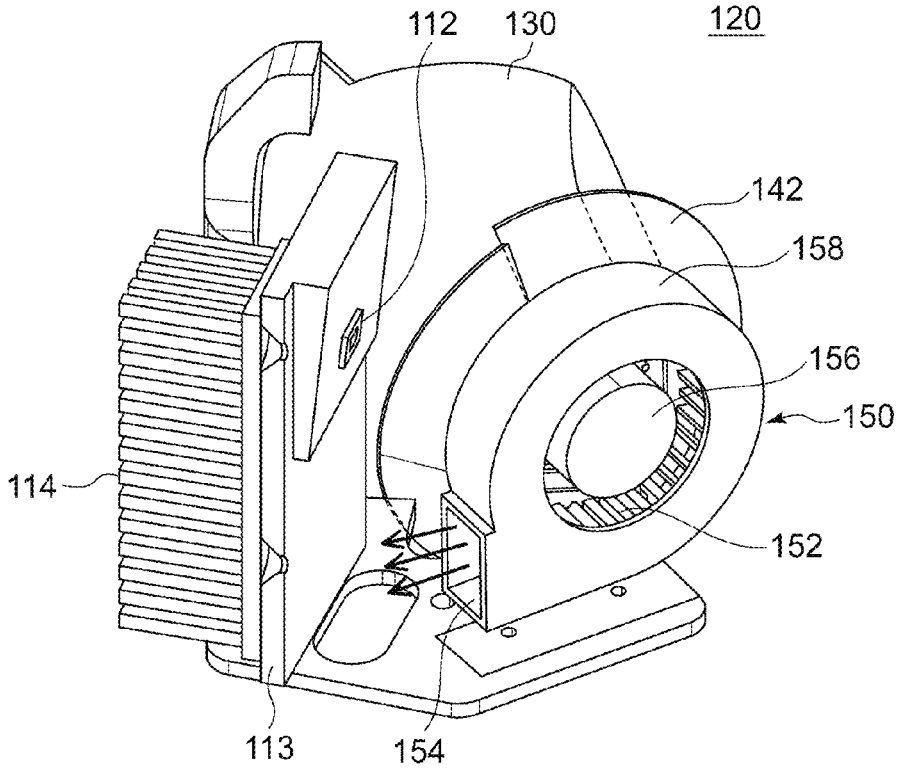
FIG. 9 is a perspective view of the optics unit illustrated in FIG. 7 as viewed from the rear side of the vehicle.

FIG. 8 is a top view of the optics unit 120 illustrated in FIG. 7, and FIG. 9 is a perspective view of the optics unit 120 as viewed from the rear side of the vehicle. The optics unit 120 includes the rotary reflector 140, an LED 112 serving as a light source, and a convex lens 130 serving as a projection lens disposed in front of the rotary reflector 26. In place of the LED 112, a semiconductor light-emitting element, such as an EL element or an LD element, may be used as a light source. Alternatively, a semiconductor laser or a light source that emits light by pumping a fluorescent body with a semiconductor laser may be used, or a combination of such a light source and an LED may be used as a light source.

As illustrated in FIGS. 8 and 9, a heat sink 114 for facilitating heat dissipation of the LED is disposed behind the LED 112.

The shape of the convex lens 130 may be selected as appropriate in accordance with such light-distribution characteristics as required light-distribution pattern and illuminance distribution, and an aspherical lens or a free-form surface lens is used. In the present embodiment, a part of the convex lens 130 is cut out, which allows the rotary reflector to be seen from the front of the vehicle (see FIG. 7).

The rotary reflector 140 rotates unidirectionally about an axis of rotation with a driving source 132, such as a motor. The rotary reflector 140 includes a plurality of blades 142 (two in the present embodiment) having a reflective surface that reflects light emitted by the LED 112 to form a desired light-distribution pattern as the rotary reflector 140 rotates by a predetermined angle, and the blades 142 are provided in the circumferential direction of a cylindrical rotation unit 144. Similarly to the blades 26*a* of the rotary reflector 26 according to the first embodiment, each blade 142 is shaped such that a secondary light source produced by reflection is formed near the focal point of the convex lens 130. In addition, the blade 142 has a twisted shape such that the angle formed by the optical axis and the reflective surface changes along the circumferential direction with the axis of rotation being the center.

As described with reference to FIG. 6, the optics unit 120 can form a substantially rectangular high-beam light-distribution pattern by reflecting light from the LED 112 with the rotary reflector 140 and scanning the front with the reflected light.

With regard to the rotary reflector 26 described in the first embodiment, the LED 28 is disposed in front thereof, and the rotary reflector is also used as a cooling fan that blows the air toward the LED 28. However, the airflow is produced in a direction parallel to the axis of rotation of the rotary reflector due to the shape of the blades of the rotary reflector, and thus a large portion of the produced airflow misses the LED, and sufficient cooling effect cannot be expected.

In the present embodiment, a cooling fan 150 is provided on a side opposite to the reflective surface of the blades 142 of the rotary reflector 140. The cooling fan 150 is attached to the rotation unit 144 of the rotary reflector and is driven along with the rotary reflector 140 by the aforementioned motor. The cooling fan 150 is provided on a side opposite to the reflective surface of the blades, and thus the cooling fan 150 has no influence on a light-distribution pattern formed by the rotary reflector.

The cooling fan 150 is a so-called blower fan in which a multi-blade unit 156 is rotatably housed in a cylindrical housing 158. The multi-blade unit 156 shares the axis of rotation with the rotary reflector 140. The cooling fan 150 is configured to take in the air through an inlet 152 formed in the base of the housing 158 and discharge the air compressed by the rotation of the multi-blade unit 156 through an outlet 154 formed in the side face of the housing 158. As a blower fan is used as the cooling fan, the airflow can be produced in a direction orthogonal to the axis of rotation of the rotary reflector. The airflow produced by the cooling fan 150 does not directly hit the rotary reflector 140, and thus the airflow has no influence on the number of rotations or the rotation speed of the rotary reflector. In addition, as the inlet 152 is disposed on a side opposite to the rotary reflector 140, the air can be taken in without being affected by the rotary reflector.

The cooling fan 150 may be fabricated separately from the rotary reflector 140 and detachably mounted thereto. Alternatively, the rotary reflector 140 and the cooling fan 150 may be integrated so as to reduce the number of components.

As can be seen from FIG. 9, the outlet 154 of the cooling fan 150 is directed toward the base of the heat sink 114 for the LED 112. Therefore, a large portion of the airflow from the cooling fan hits the base of the heat sink, and the cooling efficiency of the LED can thus be improved.

Figure 10:
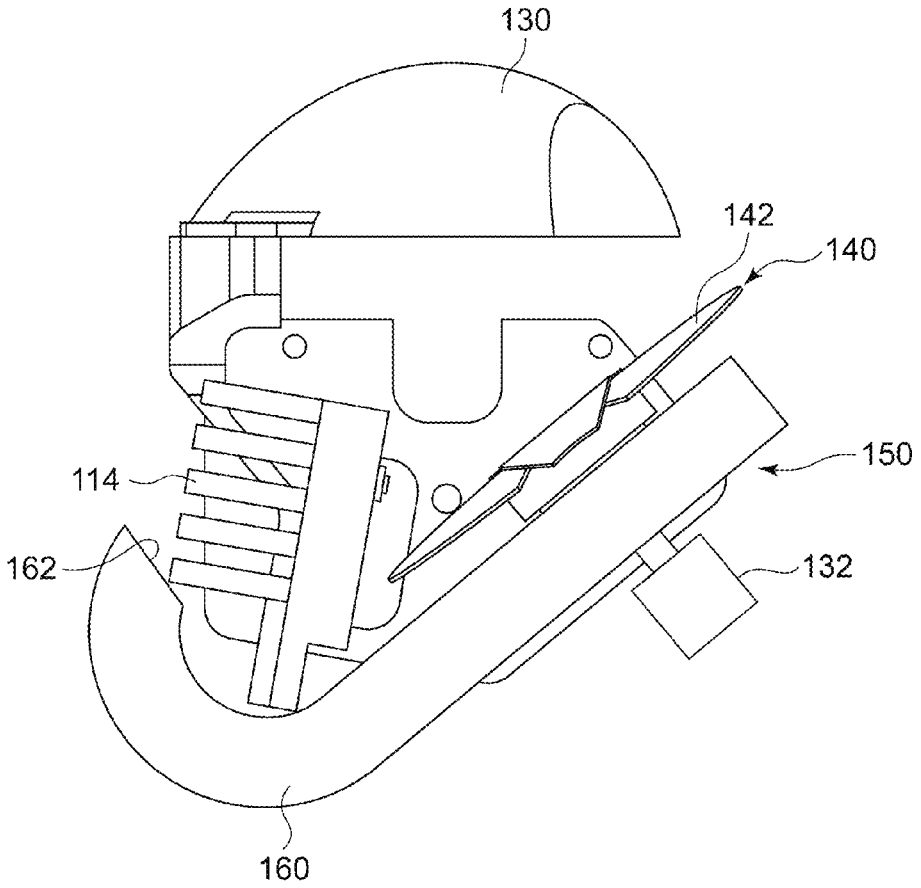
FIG. 10 is a top view illustrating a modification of an optics unit.

FIG. 10 is a top view illustrating a modification of the optics unit 120. In this optics unit, a pipe-like air duct 160 is connected to the outlet 154 of the cooling fan 150. The air duct 160 extends from the outlet 154 and is then bent in a J-like shape. The air duct 160 includes an opening 162 located above the heat sink 114 for the LED. Thus, the cooling efficiency of the LED by the heat sink can be further improved by guiding the airflow produced by the cooling fan to directly hit the heat sink from the above by using the air duct.

The air duct 160 may be configured to blow the air against another heat-radiating source. For example, the air duct 160 may be configured such that the opening 162 faces a motor that drives the rotary reflector and the fan, or the air duct may be configured such that the opening faces a heat sink for an LED in the adjacent lamp unit 118. Alternatively, the air duct may be designed so that a convection current is produced substantially throughout the lamp room of the vehicular lighting fixture 100. In particular, in the case of the latter, an effect of defogging the front cover of the vehicular lighting fixture can be expected. The air duct may branch midway to a plurality of pipes, and the pipes may blow the air against respective heat-radiating sources.

Figure 11:
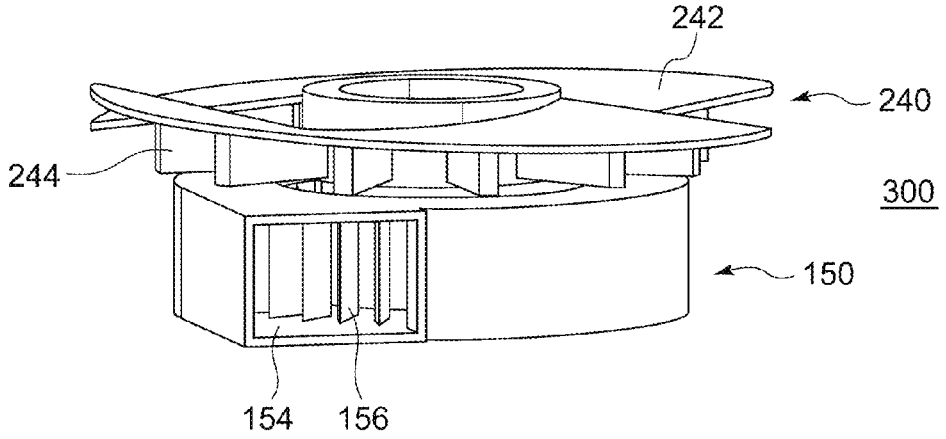
FIG. 11 is a side perspective view of an assembly constituted by a rotary reflector and a fan according to a modification.
Figure 12:
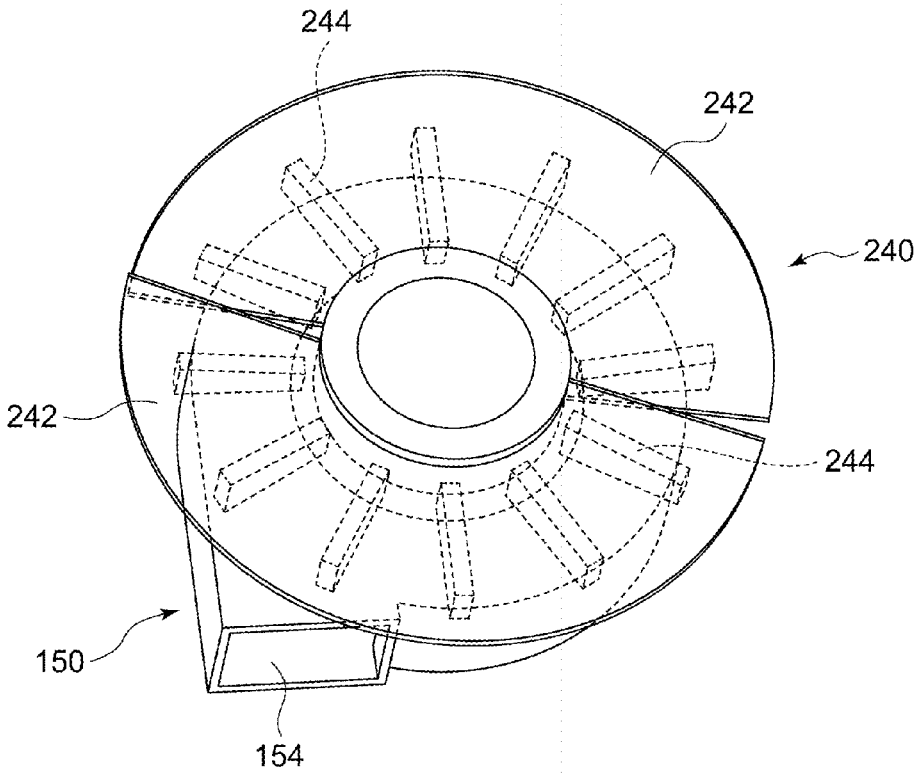
FIG. 12 is a top perspective view of the assembly illustrated in FIG. 11.

FIG. 11 is a side perspective view of an assembly 300 in which a rotary reflector 240 according to a modification of the present embodiment and the cooling fan 150 described above are combined. This assembly 300 can be replaced by the assembly constituted by the rotary reflector 140 and the cooling fan 150 illustrated in FIG. 7. FIG. 12 is a top perspective view of the assembly 300 illustrated in FIG. 11. FIG. 12 depicts the rotary reflector 240 in phantom to show the structure of its lower side.

As can be seen from FIGS. 11 and 12, in the rotary reflector 240, a plurality of fins 244 are provided on a side opposite to the reflective surface of blades 242. The fins 244 are provided so as to stand substantially perpendicularly relative to the surface of the blades 242. Six fins 244 are provided on each blade 242, but the number of the fins 244 is not limited to six. Angles formed by adjacent fins 244 may or may not be uniform.

Since the fins are provided on a side opposite to the reflective surface of the rotary reflector, the fins do not affect a light-distribution pattern formed by the reflective surface. In addition, there is no possibility that dust adheres to the reflective surface due to a turbulent flow produced by the fins.

The plurality of fins 242 produce an airflow in addition to the airflow produced by the cooling fan 150 when the rotary reflector 240 rotates, and thus a convection current inside the vehicular lighting fixture increases. Therefore, the cooling efficiency of the heat-radiating source in the vehicular lighting fixture further improves, and defogging of the front cover can be facilitated.

As described above, the rotary reflector and the cooling fan share the axis of rotation, and thus the moment of inertia of the assembly constituted by the rotary reflector and the cooling fan is greater than that of the rotary reflector alone. Therefore, when the optics unit 120 is driven to turn on a high beam, the time it takes for the rotary reflector to reach a predetermined number of rotations is greater than the time it takes for the rotary reflector alone to reach the predetermined number of rotations. This is recognized by the driver as a phenomenon in which flicker appears initially when the high beam is turned on.

Therefore, the assembly of the optics unit 120 may be rotated without turning on the LED from the time when the vehicle starts idling or from the time when the low-beam lamp unit is turned on. The number of rotations at this point may be equal to a predetermined number of rotations to be held when a high beam is turned on or may be lower than this predetermined number of rotations. When a high beam is necessary, the LED may be turned on while the aforementioned number of rotations is retained or is increased to the predetermined number of rotations. Then, the rising time can be eliminated or reduced, and the flicker of the high beam can be prevented.

Thus far, the present invention has been described with reference to the foregoing embodiments. The present invention, however, is not limited to the foregoing embodiments and encompasses an embodiment obtained by combining or replacing configurations of the foregoing embodiments as appropriate. In addition, it is possible to change the combinations or processing procedures in the foregoing embodiments or to add modifications such as various design changes to the foregoing embodiments on the basis of the knowledge of a person skilled in the art, and an embodiment obtained by adding such a modification can also be encompassed within the scope of the present invention.

In each of the foregoing embodiments, a case in which the lamp unit is applied to a vehicular lighting fixture has been described, but an application is not limited to this field. For example, the lamp unit may also be applied to a lighting device for a stage or an entertainment facility in which lighting is carried out while switching various light-distribution patterns. Conventionally, a lighting device in this field requires a large-scale driving mechanism for changing an illumination direction. With the lamp unit according to the foregoing embodiments, various light-distribution patterns can be formed by rotating the rotary reflector and turning on/off the light source, which renders a large-scale driving mechanism unnecessary and can reduce the size of the lighting device.

What is claimed is:

1. An optics unit, comprising:

a light source;

a rotary reflector that includes:

a rotation unit that rotates about an axis of rotation, and a blade mounted on the rotation unit, the blade including a reflective surface that reflects light emitted by the light source;

a fan that includes a vane that rotates along with the rotation unit; and a plurality of fins provided on a surface of the rotary-reflector blade, on a side thereof reverse from its reflective surface.

2. The optics unit according to claim 1, wherein the fan is a blower fan.

3. The optics unit according to claim 1, wherein the fan is provided to a side of the rotary reflector reverse from its reflective surface.

4. The optics unit according to claim 1, provided with an air duct for guiding airflow produced by the fan to either the light source or a motor for rotationally driving the rotary reflector.

5. A vehicular lighting fixture, comprising the optics unit according to claim 1.

6. The vehicular lighting fixture according to claim 5, wherein the rotary reflector and the fan are driven starting with either vehicular idling, or when the vehicular lighting fixture is switched to low beam.

* * * * *